US006112528A

United States Patent [19]

Rigby

[11] Patent Number: 6,112,528

[45] Date of Patent: Sep. 5, 2000

[54] PROCESS FOR UNLOADING PRESSURIZED LIQUEFIED NATURAL GAS FROM CONTAINERS

[75] Inventor: James R. Rigby, Kingwood, Tex.

[73] Assignee: ExxonMobil Upstream Research Company, Houston, Tex.

[21] Appl. No.: 09/464,987

[22] Filed: Dec. 16, 1999

Related U.S. Application Data

[60] Provisional application No. 60/112,892, Dec. 18, 1998.

[51] Int. Cl.[7] ..... F17C 7/04

[52] U.S. Cl. ..... 62/48.1; 222/3

[58] Field of Search ..... 62/48.1; 222/3

[56] References Cited

U.S. PATENT DOCUMENTS

| | | | |
|---|---|---|---|
| 334,481 | 1/1886 | Sone . | |
| 1,753,785 | 4/1930 | Heylandt . | |
| 2,435,332 | 2/1948 | Van Vleet et al. | 62/1 |
| 2,795,937 | 6/1957 | Sattler et al. | 62/1 |
| 2,940,268 | 6/1960 | Morrison | 62/7 |
| 2,972,873 | 2/1961 | Peet et al. | 62/51 |
| 2,975,608 | 3/1961 | Morrison | 62/53 |
| 2,983,409 | 5/1961 | Henry | 222/399 |
| 3,004,509 | 10/1961 | Leroux | 114/74 |
| 3,018,632 | 1/1962 | Keith | 62/9 |
| 3,145,680 | 8/1964 | Farkas et al. | 114/74 |
| 3,232,725 | 2/1966 | Secord et al. | 48/190 |
| 3,257,813 | 6/1966 | Hashemi-Tafreshi | 62/23 |

(List continued on next page.)

FOREIGN PATENT DOCUMENTS

WO 97/16678 5/1997 WIPO ..... F17C 1/00

OTHER PUBLICATIONS

Bennett, C. P. Marine Transportation of LNG at Intermediate Temperature, *CME* (Mar. 1979), pp. 63–64.

Faridany, E. K., Secord, H.C, O'Brien, J. V., Pritchard, J. F., and Banister, M. The Ocean Phoenix Pressure–LNG System, *Gastech 76* (1976), New York, pp. 267–280.

Faridany, E. K., Ffooks R. C., and Meikle, R. B. A Pressure LNG System, *European Offshore Petroleum Conference & Exhibition* (Oct. 21–24, 1980), vol. EUR 171, pp. 245–254.

Broeker, R. J. CNG and MLG–New Natural Gas Transportation Processes, *American Gas Journal* (Jul. 1969) pp. 138–140.

Fluggen, Prof. E. and Backhaus, Dr. I. H. Pressurised LNG—and the Utilisation of Small Gas Fields, *Gastech78, LNG/LPG Conference* (Nov. 7, 1978), Monte Carlo pp. 195–204.

Broeker, R. J. A New Process for the Transportation of Natural Gas, *Proceedings of the First International Conference on LNG* (1968), Chicago, Illinois, Session No. 5, Paper 30, 1–11.

Ladkany, S. G. Composite Aluminum–Fiberglass Epoxy Pressure Vessels for Transportation of LNG at Intermediate Temperature, published in *Advances in Cryogenic Engineering, Materials, vol. 28*, (*Proceedings of the 4th International Cryogenic Materials Conference*), San Diego, CA, USA, Aug. 10–14, 1981, pp. 905–913.

*Primary Examiner*—Ronald Capossela
*Attorney, Agent, or Firm*—Gary D. Lawson

[57] ABSTRACT

A process is disclosed for unloading a plurality of containers having pressurized liquefied gas contained therein. A pressurized displacement gas is fed to a first container or group of containers to discharge the liquefied gas therefrom. The displacement gas is then withdrawn from the first container or group and it is separated into a first vapor stream and a second vapor stream. The first vapor stream is heated and passed to the first container or group. The second vapor stream is fed to a second container or group to discharge liquefied gas therefrom. Communication between the first container or group and the second container or group is severed and the foregoing steps are repeated for all of the containers in succession, with only the last container or group emptied of liquid remaining at the pressure of the displacement gas, and all of the containers at the end of the process except the last container or group being filled with a lower pressure vapor.

13 Claims, 2 Drawing Sheets

U.S. PATENT DOCUMENTS

| | | | |
|---|---|---|---|
| 3,293,011 | 12/1966 | Lewis et al. | 48/190 |
| 3,298,805 | 1/1967 | Secord et al. | 48/190 |
| 3,324,670 | 6/1967 | Van Kleef | 62/55 |
| 3,365,898 | 1/1968 | Van Kleef | 62/55 |
| 3,422,779 | 1/1969 | Becker | 114/74 |
| 3,477,509 | 11/1969 | Arendt | 166/252 |
| 3,535,885 | 10/1970 | Frijlink | 62/9 |
| 3,690,115 | 9/1972 | Clayton | 62/49 |
| 3,830,180 | 8/1974 | Bolton | 114/74 |
| 3,831,811 | 8/1974 | Becker | 222/1 |
| 3,842,613 | 10/1974 | Becker | 62/50 |
| 3,877,240 | 4/1975 | Kniel et al. | 62/50 |
| 4,182,254 | 1/1980 | Secord | 114/74 |
| 4,202,180 | 5/1980 | Cox | 62/48.1 |
| 4,292,909 | 10/1981 | Conway | 114/74 |
| 4,315,407 | 2/1982 | Creed et al. | 62/53 |
| 4,446,804 | 5/1984 | Kristiansen et al. | 114/74 |
| 5,199,266 | 4/1993 | Johansen | 62/8 |
| 5,211,021 | 5/1993 | Pierson | 62/50 |
| 5,243,821 | 9/1993 | Schuck et al. | 62/50 |
| 5,377,723 | 1/1995 | Hilliard, Jr. et al. | 141/4 |
| 5,398,629 | 3/1995 | Wasenius | 114/74 |
| 5,454,408 | 10/1995 | DiBella et al. | 141/197 |
| 5,476,126 | 12/1995 | Hilliard, Jr. et al. | 141/63 |
| 5,513,680 | 5/1996 | Hilliard, Jr. et al. | 141/4 |
| 5,950,453 | 9/1999 | Bowen et al. | 62/612 |

PROCESS FOR UNLOADING PRESSURIZED LIQUEFIED NATURAL GAS FROM CONTAINERS

This application claims the benefit of U.S. Provisional Application Ser. No. 60/112,892, filed Dec. 18, 1998.

FIELD OF THE INVENTION

This invention relates to the handling of pressurized liquefied natural gas and, more particularly, to a process for unloading containers having pressurized liquefied natural gas contained therein.

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

It has been recently proposed to transport natural gas at temperatures above −112° C. (−170° F.) and at pressures sufficient for the liquid to be at or below its bubble point temperature. For most natural gas compositions, the pressure of the natural gas at temperatures above −112° C. will be between about 1,380 kPa (200 psia) and about 4,500 kPa (650 psia). This pressurized liquid natural gas is referred to as PLNG to distinguish it from LNG, which is transported at near atmospheric pressure and at a temperature of about −162° C. (−260° F.).

If PLNG is unloaded from a container by pumping the PLNG out and allowing the container pressure to decrease, the decompression of the PLNG can lower the temperature in the container below the permitted design temperature for the container. If the pressure in the container is maintained as the PLNG is removed to avoid such temperature reduction, the vapor remaining in the container will contain a significant mass percentage of the container's original cargo. Depending upon the pressure and temperature of storage and the composition of the PLNG, the vapors may constitute from about 10 to 20 percent of the mass of PLNG in the container before the liquid was removed. It is desirable to remove as much of this gas as is economically possible while keeping the container at approximately the same temperature as the PLNG before unloading.

SUMMARY

This invention relates to a process for unloading a plurality of containers having liquefied gas contained therein. A pressurized displacement gas is fed to a first container or group of containers of said plurality of containers to discharge the liquefied gas therefrom. The discharging gas is then withdrawn, preferably using a compressor, from the first container or group of containers and the displacement gas is separated into a first vapor stream and a second vapor stream. The first vapor stream pulled off of the compressor is heated and passed to the first container or first group of containers, thereby maintaining the cargo in the first container or group at or above the design temperature. The second vapor stream at the compressor outlet is withdrawn and fed to a second container or second group of containers of the plurality of containers to discharge liquefied gas therefrom. Communication between the first container or group and the second container or group is severed and these steps are repeated for all of the containers in succession, with only the last container emptied of liquid remaining at the pressure of the displacement gas, and all of the containers at the end of the process except the last container being filled with the lower pressure vapor.

In the practice of this invention, a container or group of containers are emptied by pressuring out the liquid with gas, leaving the tanks liquid-empty but full of pressurized gas. The gas remaining in the container or group of containers is then partially removed and used to pressure out the next container or group of containers of approximately the same volume. During the step in which gas is being removed from the liquid-empty containers and "rolled" into the next liquid-filled container or group of containers, the pressure drops in the liquid empty containers. In order to maintain the temperature above the critical temperature in the containers that are having gas removed from them, some of the gas being evacuated is heated and recycled back into these tanks. At the end of the process the liquid is removed from the containers and all but the last container or group of containers are at low pressure, preferably between about 690 kPa (100 psia) and 1,380 kPa (200 psia), while the last is at slightly above the bubble point pressure. The lower pressure vapor remaining in the containers will comprise substantially less mass than if the containers are emptied of liquefied gas and filled with high-pressure gas. The gas in the containers is typically reliquefied or used as fuel gas when the containers are reloaded with liquefied gas. Increasing the percentage of the cargo delivered and reducing the amount of gas to be reliquefied at the liquefaction plant can significantly reduce the overall cost of transporting the liquefied gas.

BRIEF DESCRIPTION OF THE DRAWINGS

The present invention and its advantages will be better understood by referring to the following detailed description and the attached drawings, which are schematic flow diagrams of representative embodiments of this invention.

Figure 1A:
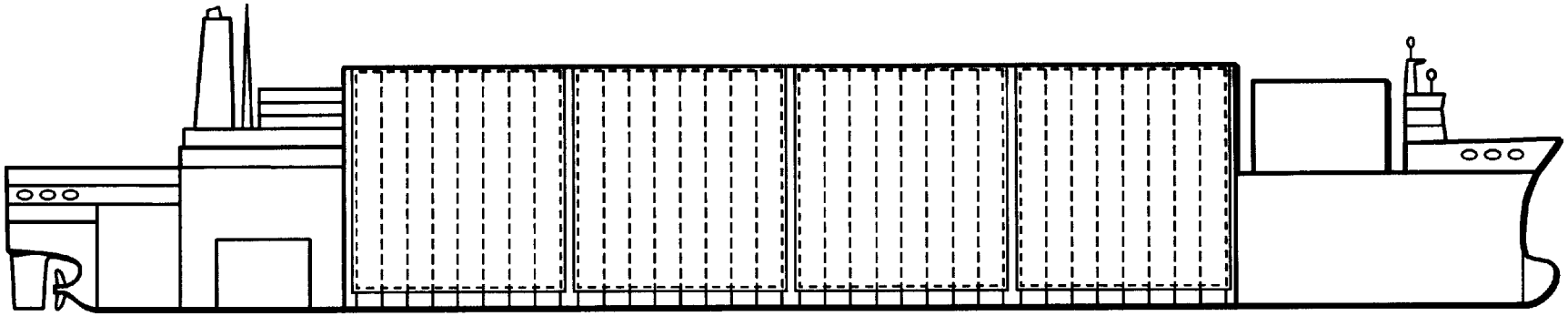
FIG. 1A is side view of a ship having pressurized liquefied gas loaded thereon which is to be unloaded in accordance with the practice of this invention.

The flow diagrams illustrated in the drawings present various embodiments of practicing the process of this invention. The drawings are not intended to exclude from the scope of the invention other embodiments that are the result of normal and expected modifications of these specific embodiments. Various required subsystems such as pumps, valves, flow stream mixers, control systems, and fluid level sensors have been deleted from the Figures for the purposes of simplicity and clarity of presentation.

DETAILED DESCRIPTION OF THE INVENTION

This invention provides a process for unloading a multiplicity of containers that uses a gas to discharge pressurized liquid from the containers while maintaining a substantially constant the liquid pressure at the bottom of each container during the offloading of the liquid. The high-pressure gas left in the container is used to displace the PLNG from the next container using one or more stages of compression. During depressurization temperature is maintained using recycled warming gas split off from the compressor.

Figure 1B:
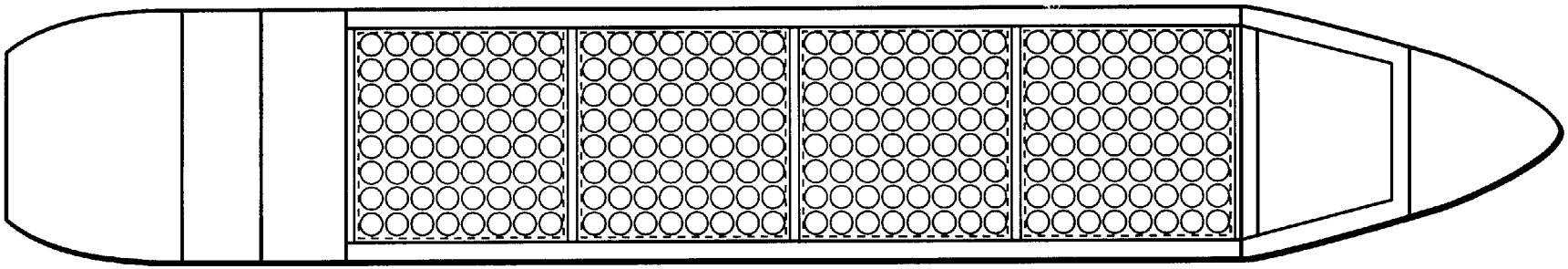
FIG. 1B is a plan view of the ship of FIG. 1A having a portion of the deck removed to show a multiplicity of containers which can be unloaded in the practice of this invention.

This description of the invention describes removal of PLNG from a PLNG ship generally shown in FIG. 1A which shows a side view of a suitable ship having a multiplicity of vertically elongated containers or vessels for transporting PLNG. It should be understood, however, that the practice of this invention is not limited to a particular design of a container to be unloaded. Nor is the practice of this invention limited to containers on ships. Any suitable container for storage of PLNG may be used in the unloading process of this invention, whether on ship on an onshore facility. Although FIGS. 1A and 1B show a plurality of vertically elongated containers on a ship, the containers could also be horizontal or both vertical and horizontal. The piping and emptying methods could also be modified in accordance with the teachings of this invention depending on the placement of the tanks and the governing regulatory bodies. Currently, governmental regulatory agencies in some jurisdictions require that containers on ships have only top connections, which limits unloading to either pumping or pressuring out if pressure is maintained during the unloading process. Onshore facilities permitting bottom connections would simplify the unloading process.

The elongated containers shown in FIG. 1B are mounted within the ship's hold and are connected to piping system for selectively filling, venting, and discharging PLNG. The containers are contained in a cold box that has suitable insulation for keeping the PLNG at cryogenic temperatures. Alternatively, insulating individual tanks is possible. Each container is in the range of about 15 to 60 meters in height and has an outer diameter of approximately 3 to 10 meters. The containers may be fabricated of any suitable material capable of enduring exposure and stress at cryogenic temperatures at the pressures required to keep PLNG at or below its bubble point temperature.

The term "bubble point" as used in this description means the temperature and pressure at which the liquid begins to convert to gas. For example, if a certain volume of PLNG is held at constant pressure, but its temperature is increased, the temperature at which bubbles of gas begin to form in the PLNG is the bubble point. Similarly, if a certain volume of PLNG is held at constant temperature but the pressure is reduced, the pressure at which gas begins to form defines the bubble point. At the bubble point, the liquefied gas is saturated liquid. For most natural gas compositions, the pressure of the natural gas at temperatures above −112° C. will be between about 1,380 kPa (200 psia) and about 4,500 kPa (650 psia).

Although this description will be described with respect to unloading PLNG from a ship, this invention is not limited to unloading PLNG. The process of this invention can be used to unload any pressurized liquefied gas.

One advantage of practicing this invention is that the liquefied gas is discharged from the containers without significantly reducing the pressure of the PLNG during the discharging step. Any significant decompression of the PLNG in the containers could reduce the temperature of the PLNG below the design temperature of the container as the PLNG flashes when the pressure drops below the bubble point.

The maximum temperature of the PLNG in the ship containers to be unloaded will depend primarily on the PLNG's composition. Natural gas, which is predominantly methane, cannot be liquefied at ambient temperature by simply increasing the pressure, as is the case with heavier hydrocarbons used for energy purposes. The critical temperature of methane is −82.5° C. (−116.5° F.). This means that methane can only be liquefied below that temperature regardless of the pressure applied. Since natural gas is a mixture of liquid gases, it liquefies over a range of temperatures. The critical temperature of natural gas is typically between about −85° C. (−121° F.) and −62 ° C. (−80° F.). This critical temperature will be the theoretical maximum temperature of PLNG in the ship containers, but the preferred storage temperature will preferably be several degrees below the critical temperature and at a lower pressure than the critical pressure.

The invention will now be described with reference to FIGS. 2, 3, and 4 which describe discharge of PLNG from containers 1, 2, and 3 that can be located onshore or on floating vessels such as ships or barges. For the sake of simplifying the description of this invention, only three containers are shown in the figures. It should be understood that this invention is not limited to a particular number of containers or groups of containers. A ship designed for transporting pressurized liquefied gas could have several hundred pressurized PLNG containers. The piping between the plurality of tanks can be so arranged that the containers can be unloaded one container at a time in succession or unloaded in groups, and any container in a series or any group can be unloaded or discharged in any sequence. The unloading sequence from a floating carrier should take into account the trim and stability of the container carrier which would be familiar to those skilled in the art.

Each container or group of containers is provided with pressure relief valves, pressure sensors, fluid level indicators, and pressure alarms systems and suitable insulation for cryogenic operation. These systems are omitted from the figures since those skilled in the art are familiar with the construction and operation of such systems, which are not essential to understanding the practice of this invention.

Figure 2:
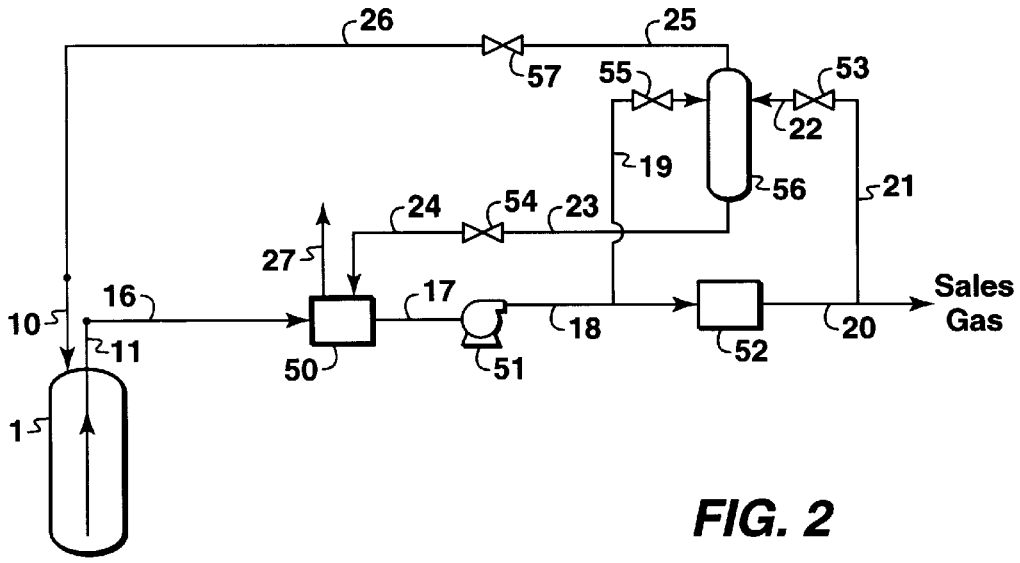
FIG. 2 is a schematic flow diagram for unloading PLNG from a first container or group of containers in accordance with the practice of this invention.

Referring to FIG. 2, to discharge PLNG from container 1 or a first group of containers, pressurized displacement gas is passed through line 10 to discharge PLNG from container 1 through line 11 which extends from near the bottom of container 1 though the top of container 1 and is connected to line 16. The piping system into which the PLNG is discharged is preferably pre-cooled and charged to an appropriate pressure prior to the unloading process to minimize flashing and to prevent excessive temperature drops. Line 11 extends to near the bottom of container 1 to maximize removal of PLNG by the displacement gas. The displacement gas for use in container 1 may come from any suitable source. For example, the displacement gas may be supplied by one or more auxiliary storage tanks or containers, from containers on the ship from which PLNG had previously been removed, or from PLNG that is vaporized. This latter source will now be described in more detail by referring to a vaporization process shown schematically in FIG. 2.

The PLNG discharged through line 11 passes through line 16 to a pump surge tank 50. From the pump surge tank 50

PLNG is passed by line 17 to pump 51 which pumps the PLNG to the desired delivery pressure of the sales gas. The high pressure PLNG exits the pump 51 by line 18 and is passed to vaporizing unit 52, except for a small fraction, preferably from about 5% to 10% of stream 18 that is withdrawn through line 19, passed through a suitable expansion device 55, such as a Joule-Thomson valve, and passed into a separation means 56.

Vaporizer 52 can be any conventional system for re-vaporizing the liquefied gas, which are well known to those skilled in the art. The vaporizer 52 may for example use a heat transfer medium from an environmental source such as air, sea water, or fresh water or the PLNG in the vaporizer may serve as a heat sink in a power cycle to generate electrical energy. A portion, preferably from about 5% to 10%, of the sales gas (line 20) exiting the PLNG vaporizer 52 may be withdrawn through line 21 and passed through an expansion device 53, such as a Joule-Thomson valve, to reduce the gas pressure. From the expansion device 53, the expanded gas enters separation means 56 by line 22. Separation means 56 can comprise any device suitable for producing a vapor stream and a liquid stream, such as a packed column, trayed column, spray tower, or fractionator. A liquid stream 23 is withdrawn from the bottom the separation means 56 and passed through an expansion device 54 to reduce the pressure of the liquid before it is passed by line 24 to the PLNG pump surge tank 50. The overhead vapor from the separation means 56 is passed through line 25, through an expansion device 57, such as a Joule-Thomson valve, to lower the pressure of the gas. After exiting the expansion device 57, the displacement gas is passed by line 26, through line 10 (lines 26 and 10 being connected to each other), and passed into the top of container 1. Once the PLNG in container 1 has been substantially discharged therefrom, injection of displacement gas into container 1 is stopped. At this stage of the process, container 1 is full of relatively high-pressure displacement gas. It is desirable to remove this high-pressure gas from container 1 to further reduce the mass of hydrocarbons in container 1.

Over time, excess vapor may buildup in the surge tank 50. This excess vapor can be removed through flow line 27 which can be connected to any suitable device depending on the design of the unloading system. Although not shown in the drawings, the excess vapor for example may be compressed and passed into separation means 56, it may be passed to a fuel gas system for powering turbines or engines, or it may be combined with gas stream 31 of FIGS. 3 and 4 to become part of the recycle gas.

Figure 3:
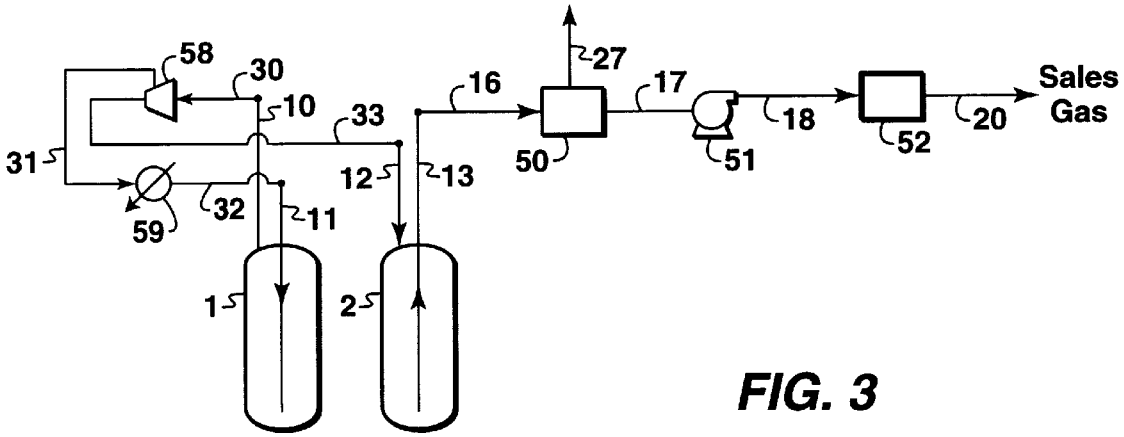
FIG. 3 is a schematic flow diagram for displacing PLNG from a second container or group of containers by evacuating the first container or group of containers to a low pressure.

FIG. 3 shows the principal gas and liquid flow lines used in the process of this invention for displacing liquid from container 2. In FIG. 3 and the other Figures in this description, flow lines and other equipment having like numerals have the same process functions. Those skilled in the art will recognize, however, that the flow lines sizes and flow rates may vary in size and capacity to handle different fluid flow rates and temperatures from one container to another.

Referring to FIG. 3, the high pressure displacement gas in container 1 at the end of the PLNG discharging step (the process depicted in FIG. 2) is removed through line 10 and passed through line 30 (which is connected to line 10) and passed to one or more compressors 58. A portion of the compressed displacement gas is withdrawn from the compressor through line 31 and passed to a heat exchanger 59. Any suitable heat transfer medium may be used for indirect heat exchange with the compressed displacement gas in heat exchanger 59. Nonlimiting examples of suitable heat sources may include exhaust gases from ship engines and environmental sources such as air, salt water, and fresh water.

From the heat exchanger 59, the heated gas is introduced to the bottom of container through line 11, which is in communication with the heat exchanger through line 32. The remaining fraction of the displacement gas that was compressed by compressor 58 is passed through line 33 and line 12 into container 2 to displace PLNG from container 2 through line 13. The PLNG is then revaporized in the same manner as described above with respect to PLNG removed from container 1. Since the displacement gas for container 2 is obtained from the high-pressure gas in container 1, separation means 56 and vapor therefrom may not be needed to provide displacement gas for container 2 or other containers unloaded in the series.

Figure 4:
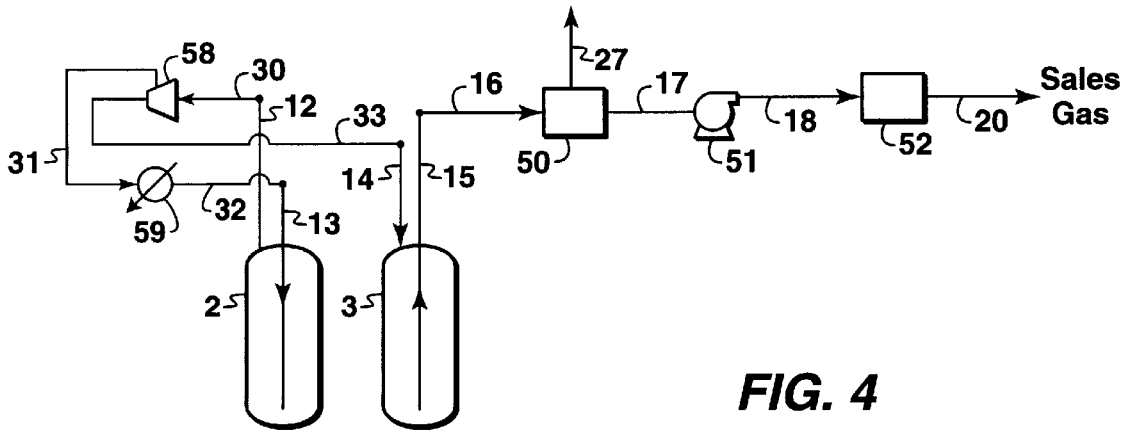
FIG. 4 is a schematic flow diagram for displacing PLNG from a third container or group of containers by evacuating the second container or group of containers to a low pressure.

FIG. 4 shows the principal gas and liquid flow lines used in the process of this invention for displacing liquid from container 3 and removing at least a portion of the high pressure displacement gas from container 2 by lowering the gas pressure. High-pressure displacement gas is used to displace PLNG from container 2 is withdrawn from container 2 by the suction of compressor 58. The high-pressure displacement gas passes from container 2 through lines 12 and 30 to one or more compressors 58 to boost the gas pressure. A fraction of the compressed displacement gas is withdrawn from the compressor through line 31 and passed to a heat exchanger 59 wherein the gas is heated. From the heat exchanger 59, the heated displacement gas is introduced to the bottom of container 2 through line 13, which is in fluid communication with the heat exchanger through line 32. The remaining fraction of the gas compressed by compressor 58 is passed through lines 33 and 14 into container 3 to displace PLNG from container 3 through line 15. The PLNG from container 3 is then revaporized in the same manner as described above with respect to PLNG removed from container 2. Unloading of all containers on a carrier ship or onshore facility is continued as described above until the last container (or group of containers) is unloaded. In the practice of this unloading method, all of the containers are full of low-pressure gas except the last container or group of containers. The last container in the series, container 3 in this description, is left at or above the bubble point pressure of the PLNG to facilitate reloading of PLNG on the return trip for reloading of PLNG.

If the low pressure displacement gas is derived from the PLNG as described in this description, the mass of low pressure gas remaining in the containers after unloading of PLNG will represent about 1 to 3 percent of the mass of the original load of PLNG. The temperature and pressure of the gas will at all times during the unloading process be within the minimum design temperature and maximum design pressure for the containers.

As the displacement gas is introduced into the containers to discharge PLNG, the pressure of the displacement gas is preferably regulated so as to keep the pressure of the PLNG at the bottom of the containers essentially constant. This is desirable to increase container cargo capacity for a given wall thickness by minimizing the maximum design pressure and to prevent flashing of the PLNG at the top of the downcomer during unloading. Depending on the design criteria for construction of the containers, avoiding any decrease of the temperature of the PLNG in the containers may be desirable to avoid dropping the temperature below the design temperature for the container.

To further guard against any lowering of the temperature during the step of discharging PLNG, the displacement gas may optionally be heated prior to entering the containers.

EXAMPLE

A hypothetical mass and energy balance was carried out to illustrate the embodiment illustrated in the FIGS. 2–4, and the results are set forth in Tables 1, 2, 3 and 4 below.

The data presented in the Tables are offered to provide a better understanding of the pressure and temperature of flow streams shown in FIGS. 2, 3, and 4, but the invention is not to be construed as unnecessarily limited thereto. Table 1 provides compositional data for the container cargo at various conditions. Each of the containers was assumed to have a capacity of 828 $m^3$ and to have an elevation difference of 46 meters from the top of the container to its bottom. It should be noted that loading rates and the source of the displacement gas would affect these compositions. Table 2 provides data for flow lines associated with FIG. 2, Table 2 provides data for flow lines associated with FIG. 3, and Table 4 provides data for flow lines associated with FIG. 4. The temperatures, pressures, and compositions are not to be considered as limitations upon the invention that can have many variations in cargo compositions and flow rates in view of the teachings herein. In this example, liquid filled containers are 98% by volume liquid with 2% vapor space:

TABLE 1

Molar percentage of components ar various container conditions

| Component | Liquid-Filled | High Pressure Gas (Displacement gas in container 1 at the beginning of the process shown in FIG. 3) | Low Pressure Gas (Gas in container 1 at the end of the process shown in FIG. 3) |
|---|---|---|---|
| $C_1$ | 93.82 | 98.63 | 98.60 |
| $C_2$ | 4.01 | 0.82 | 0.76 |
| $C_3$ | 0.28 | 0.03 | 0.03 |
| $C_{4i}$ | 0.43 | 0.03 | 0.07 |
| $C_{4n}$ | 0.13 | 0.008 | 0.02 |
| $C_{5i}$ | 0.18 | 0.01 | 0.04 |
| $C_{5n}$ | 0.05 | 0.003 | 0.01 |
| $C_{6+}$ | 0.05 | 0.003 | 0.01 |
| $CO_2$ | 1.01 | 0.38 | 0.36 |
| Temperature (° F., ° C.) | −139, −95 | −135, −93 | −139, −95 |
| Pressure at top of container (psia; kpa) | 412; 2841 | 435; 2999 | 127; 876 |

TABLE 2

| Stream | Percent of PLNG discharged from container 1 | Vapor/Liquid | ° C. | ° F. | kPa | psia |
|---|---|---|---|---|---|---|
| 10 | 0 | V | −93.3 | −136 | 2,848 | 413 |
| 11 @ bottom* | 0 | L | −95 | −139 | 2,999 | 435 |
| 10 | 50 | V | −93.3 | −136 | 2,917 | 423 |
| 11 @ bottom* | 50 | L | −95 | −139 | 2,999 | 435 |
| 10 | 100 | V | −93.3 | −136 | 2,979 | 432 |
| 11 @ bottom* | 100 | L | −94.4 | −138 | 2,999 | 435 |
| 18 | 50 | L | −86.1 | −123 | 8,274 | 1200 |
| 20 | 50 | V | 1.7 | 35 | 8,274 | 1200 |
| 25 | 50 | V | −93.3 | 136 | 3,103 | 450 |

*Conditions of PLNG at the lower end of flow line 11.

TABLE 3

| Stream | Percent of PLNG discharged from container 2 | Vapor/Liquid | ° C. | ° F. | kPa | psia |
|---|---|---|---|---|---|---|
| 10 | 0 | V | −94.4 | −138 | 2,999 | 435 |
| 11 | 0 | V | 10 | 50 | 2,979 | 432 |
| 10 | 50 | V | −95 | −139 | 2,234 | 324 |
| 11 | 50 | V | 10 | 50 | 2,220 | 322 |
| 10 | 100 | V | −95 | −139 | 883 | 128 |
| 11 | 100 | V | 10 | 50 | 876 | 127 |
| 12 | 0 | V | −82.2 | −116 | 2,848 | 413 |
| 13 @ bottom* | 0 | L | −95 | −139 | 2,999 | 435 |
| 12 | 50 | V | −67.8 | −90 | 2,917 | 423 |
| 13 @ bottom* | 50 | L | −94.4 | −138 | 2,999 | 435 |
| 12 | 100 | V | −8.3 | 17 | 2,979 | 432 |
| 13 @ bottom* | 100 | L | −92.8 | −135 | 2,999 | 435 |
| 18 | 50 | L | −86.1 | −123 | 8,274 | 1200 |
| 20 | 50 | V | 1.7 | 35 | 8,274 | 1200 |

*Conditions of PLNG at the lower end of flow line 13.

TABLE 4

| Stream | Percent of PLNG discharged from container 2 | Vapor/Liquid | ° C. | ° F. | kPa | psia |
|---|---|---|---|---|---|---|
| 12 | 0 | V | −94.4 | −138 | 2,999 | 435 |
| 13 | 0 | V | 10 | 50 | 2,979 | 432 |
| 12 | 50 | V | −95 | −139 | 2,234 | 324 |
| 13 | 50 | V | 10 | 50 | 2,220 | 322 |
| 12 | 100 | V | −95 | −139 | 883 | 128 |
| 13 | 100 | V | 10 | 50 | 876 | 127 |
| 14 | 0 | V | −82.2 | −116 | 2,848 | 413 |
| 15 @ bottom* | 0 | L | −95 | −139 | 2,999 | 435 |
| 14 | 50 | V | −67.8 | −90 | 2,917 | 423 |
| 15 @ bottom* | 50 | L | −94.4 | −138 | 2,999 | 435 |
| 14 | 100 | V | −8.3 | 17 | 2,979 | 432 |
| 15 @ bottom* | 100 | L | −92.8 | −135 | 2,999 | 435 |
| 18 | 50 | L | 86.1 | −123 | 8,274 | 1200 |
| 20 | 50 | V | 1.7 | 35 | 8,274 | 1200 |

*Conditions of PLNG at the lower end of flow line 15.

A person skilled in the art, particularly one having the benefit of the teachings of this patent, will recognize many modifications and variations to the specific processes disclosed above. For example, a variety of temperatures and pressures may be used in accordance with the invention, depending on the overall design of the system and the composition of the PLNG. Also, the piping connections between the PLNG containers may be supplemented or reconfigured depending on the overall design requirements to achieve optimum and efficient heat exchange requirements. As discussed above, the specifically disclosed embodiments and examples should not be used to limit or restrict the scope of the invention, which is to be determined by the claims below and their equivalents.

What is claimed is:

1. A process for unloading pressurized liquefied gas from a plurality of containers having such liquefied gas contained therein, comprising the steps of:

(a) feeding a pressurized displacement gas to a first container or group of containers of said plurality of containers to discharge the liquefied gas therefrom;

(b) withdrawing the displacement gas from the first container or group of containers and separating the displacement gas into a first vapor stream and a second vapor stream;

(c) heating the first vapor stream and passing the heated vapor stream to the first container or group of containers, the pressure of the heated vapor in the first container or group of containers being substantially lower than the pressure of the liquefied gas at the beginning of the unloading process;

(d) taking the second vapor stream and feeding it to a second container or group of containers of the plurality of containers to discharge liquefied gas therefrom; and (e) severing communication between the first container or group of containers and the second container or group of containers and repeating the steps (b) through (d) for all of said containers in succession, whereby only the last emptied container or group of containers remains at said pressure of the displacement gas at the end of the unloading process and all of the containers except the last container or group of containers being filled with the lower pressure vapor.

2. The process of claim 1 wherein the temperature of the displacement gas is above −112° C.

3. The process of claim 1 wherein the displacement gas is derived from the liquefied gas.

4. The process of claim 1 wherein in step (a) the displacement gas is introduced at the upper end of the first container.

5. The process of claim 1 wherein the pressure of the displacement gas of step (a) ranges from about 20 kPa to 345 kPa (3 to 50 psia) more than the bubble point pressure of the liquefied gas.

6. The process of claim 1 further comprises regulating the pressure of the displacement gas fed to the first container such that the pressure of the liquefied gas at the bottom of the containers remains essentially constant during discharge of the liquefied gas from the first container or group of containers.

7. The process of claim 1 wherein the pressurized liquefied gas is natural gas having a temperature above −112° C. and a pressure at essentially its bubble point pressure.

8. The process of claim 1 wherein the heated vapor stream injected into the first container or group of containers maintains fluids contained in the container or group of containers at or above a predetermined minimum temperature.

9. The process of claim 1 wherein the pressure of the gas in the first container or group of containers at the end of the unloading process is at least 345 kPa (50 psia) lower than bubble point pressure of the liquefied gas at the beginning of the unloading process.

10. The process of claim 1 further comprises regulating the pressure of the displacement gas introduced into the first container or group of containers to keep the pressure of the liquefied gas at the bottom of the containers essentially constant during unloading of the liquefied gas therefrom.

11. The process of claim 1 further comprises regulating the pressure of the displacement gas introduced into the second container or group of containers to keep the pressure of the liquefied gas at the bottom of the second container or group of containers essentially constant during unloading of the liquefied gas therefrom.

12. The process of claim 1 wherein the plurality of containers to be unloaded of liquefied gas are aboard a ship and the steps of withdrawing the displacement gas of step (b) and the heating of the first vapor stream in step (c) are performed using suitable process equipment located off the ship.

13. A process for unloading a plurality of containers having liquefied gas contained therein, said liquefied gas having a temperature above −112° C. and a pressure at essentially its bubble point, comprising the steps of:

(a) feeding a pressurized discharging gas to a first group of containers of said plurality of containers to discharge the liquefied gas therefrom, said discharging gas having a pressure greater than the pressure of the liquefied gas;

(b) withdrawing the discharging gas from the first group of containers and separating the discharging gas into a first vapor stream and a second vapor stream;

(c) heating the first vapor stream and passing the heated vapor stream to the first group of containers, thereby leaving the first group of containers full of lower pressure vapor;

(d) compressing the second vapor stream and feeding it to a second group of containers of the plurality of containers to discharge liquid gas therefrom; and (e) severing fluid communication between the first group of containers and the second group of containers and repeating the steps (b) through (d) for all of said containers in succession, whereby only the last emptied group of containers remains at said pressure of the discharging gas and all of the containers except the last group of containers being filled with the lower pressure vapor.

* * * * *